United States Patent [19]

Wang

[11] Patent Number: 4,926,506

[45] Date of Patent: May 22, 1990

[54] SANITARY LAVATORY SEAT SYSTEM

[76] Inventor: Grande Wang, No. 255, Dong Ming Road, Tali Shiang, Taichung, Taiwan

[21] Appl. No.: 226,861

[22] Filed: Aug. 1, 1988

[51] Int. Cl.[5] ..... A47K 3/18

[52] U.S. Cl. ..... 4/247

[58] Field of Search ..... 4/247

[56] References Cited

U.S. PATENT DOCUMENTS 2,079,975 5/1937 Volkmann et al. ..... 4/247

FOREIGN PATENT DOCUMENTS 445796 6/1927 Fed. Rep. of Germany ..... 4/247

*Primary Examiner*—Charles E. Phillips

[57] ABSTRACT

A sanitary lavatory seat has a right and left portion which can each be covered with paper or plastic from a roll. The roller is positioned within a casing fixed at the rear of the lavatory seat. Various gears are provided whereby the rolls can be synchronously moved by manual manipulation or by a motor. The paper will move from the rolls, over the respective right or left portions of the seat, wrap around the front of the seat and return under the seat portion to a take-up wheel axle.

8 Claims, 3 Drawing Sheets

SANITARY LAVATORY SEAT SYSTEM

BACKGROUND OF THE INVENTION

The present invention relates to a sanitary lavatory seat and more particularly to a structure for providing a right and a left paper or plastic roll for stretching to respectively cover the right and the left lavatory seat plates so as to keep the lavatory seat always in a sanitary condition.

A regular lavatory bowl comprises a lavatory seat and a lavatory cover that can be lifted. Any person who uses a lavatory bowl shall have to sit on the lavatory seat with one's thigh and hip. This is not sanitary, and furthermore a person who suffers from skin disease or infectious disease can easily to infect others. Although many people have noted this problem and tried to make improvements, there is still no product which has to be proven to be satisfactory.

In order to settle the above-mentioned problems, the present invention has finally been created with a main object of providing a sanitary lavatory seat which is always kept in a clean and sanitary condition for use.

The sanitary lavatory seat, according to the present invention, is mainly comprised of : a lavatory seat, the front end of said lavatory seat having bilaterally a transverse flat portion, and a casing fixedly allocated at the back of lavatory bowl; said casing comprising interiorly one set of paper roll wheel axles and one take-up wheel axle; said paper roll wheel axles are for allocation of paper rolls;the terminal end of each paper roll is pulled out of the casing from a bottom hole to cover the top surface of the lavatory seat and to be deflected at the front end of the lavatory seat to run under the bottom of the lavatory seat and finally to wind round the take-up wheel axle; said take-up wheel axle is connected with a driving mechanism; by means of the driving mechanism, the take-up wheel axle is rotated and to let the paper wind round the take-up wheel axle so as to let the papers that cover the right and left-hand surfaces of the lavatory seat make a synchronous movement for a fixed length, i.e. to let the seated paper move to conceal itself behind the lavatory seat around the take-up wheel axle, and at the same time, to let clean and new paper cover the lavatory seat 2 for next use.

Another object of the present invention is to provide a satitary lavatory seat wherein the casing is mainly comprised of a bottom holder, a middle holder and two side covers; said bottom holder comprises slots at the bottom for fixation of the bottom holder onto a lavatory bowl at the back, a connection hole at the front for connection of the bottom holder with the lavatory seat, and division walls around its periphery and the middle part to divide itself into three portions; said middle holder is fixed at the center and said side covers are bilaterally allocated at both ends; said middle holder comprises bilaterally one protruding wheel axle at each side for allocation of a paper roll, and a take-up wheel axle at the lower portion with both ends of the take-up wheel axle protruding beyond the side walls of the middle holder for the terminal end of the paper roll to wind thereabout; the present sanitary lavatory seat also comprises a driving mechanism which is to set a sector gear at the wheel axle for 2 paper roll, and to set a vertical axle at the top of the middle holder in the center with one hand wheel attached at the top end and with one sector gear attached at the lower end letting the sector gear engage the sector gear of the wheel axle, by means of manual operation whereby the take-up wheel axle is rotated.

Another object of the present invention is to provide a sanitary lavatory seat wherein the driving mechanism is motorized, i.e. to set a driving motor in the middle holder of the casing to connect with the take-up wheel axle by means a gear or belt through a pivot joint so as to drive the take-up wheel to rotate.

Another object of the present invention is to provide a sanitary lavatory seat wherein the take-up wheel axle is slipped with a wheel hub such that the waste paper of the paper roll can be easily removed for replacement.

Another object of the present invention is to provide a sanitary seat wherein the flat portion at the front of the lavatory seat comprises bilaterally a downward lug at both sides on the bottom to prohibit right or left displacement of the paper of each paper roll.

Yet a further object of the present invention is to provide a sanitary lavatory seat wherein the paper rolls or plastic rolls used are printed with marks to facilitate precise movement of the paper or the plastic.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
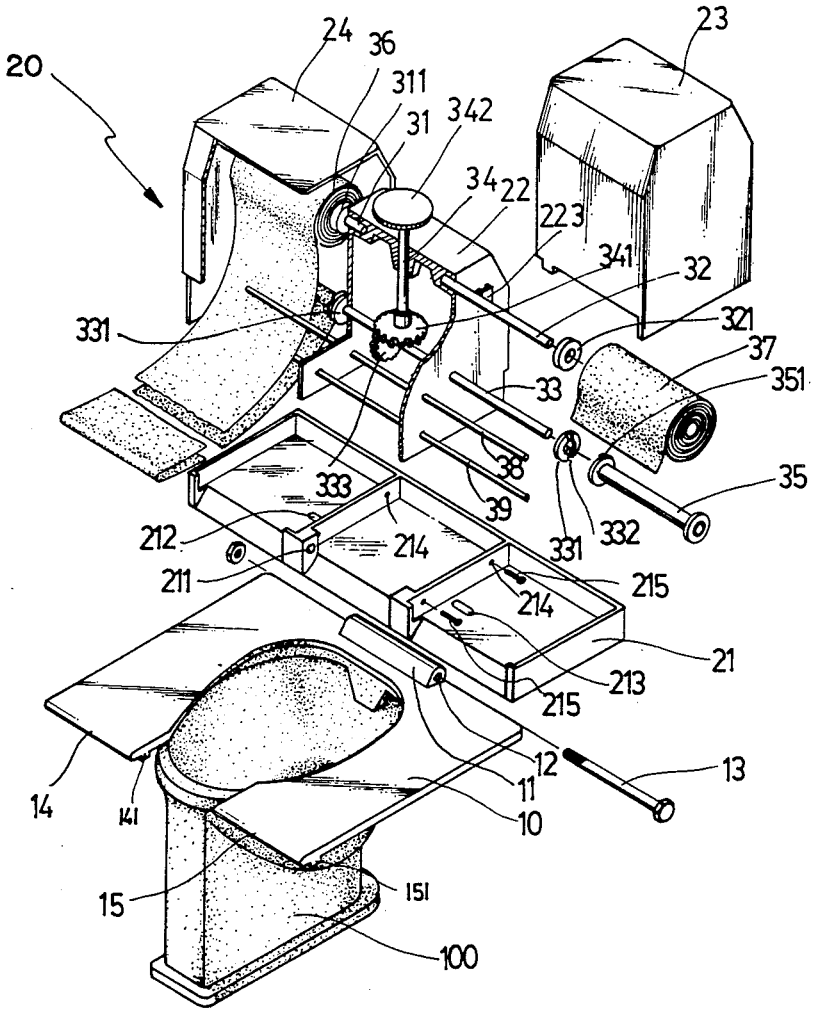
FIG. 1 is a fragmentary perspective view of a sanitary lavatory seat embodying the present invention.
Figure 2:
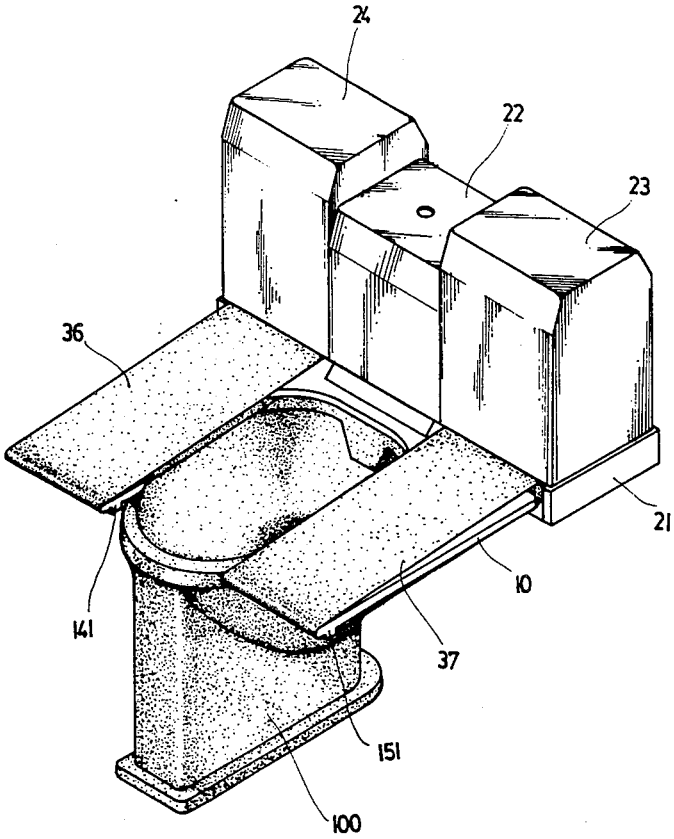
FIG. 2 is a perspective view of one preferred embodiment according to the present invention.

Referring to FIG. 1 and FIG. 2, the sanitary lavatory seat according to the present invention comprises a lavatory seat (10) and a casing (20) composed of a bottom holder (21), a middle holder (22) and two side covers (23) (24). The casing has two inside wheel axles (31) (32) for allocation of respective paper rolls, a take-up wheel axle (33), a vertical axle 34, a wheel hub (35), two paper or plastic rolls (36) (37), and two paper guide rods (38) (39).

The lavatory seat (10) comprises a protruding portion (11) at the rear end having a draft hole (12) for bolt (13) to penetrate and thereby pivotally connect the bottom holder (21) through the hole (211) of the bottom holder (21) such that the lavatory seat (10) can be lifted against the bottom holder (21). Said lavatory seat (10) is characterized by its two flat portions (14) (15) which are bilateral at the front, each of said flat portions (14) (15) comprising a respective lug (141) (151) at the bottom to prohibit the paper of the paper roll from right-handed or left-handed displacement. By means of the design of the draft hole of the protruding portion (11), the whole body of the lavatory seat (10) is arranged to be slightly inclined toward the front.

The bottom holder (21) of the casing (20) has two slots (212) (213) for fixation of the bottom holder (21) to the lavatory bowl (100) by means of respective bolts through the bolt holes of the lavatory bowl (100). The bottom holder (21) also has division walls around its periphery and the middle part to divide itself into three portions, wherein the hole (214) is for a bolt (215) to fix the middle holder (22) onto the bottom holder (21). Said middle holder (22) has two fixed wheel axles (31) (32) with two washers (311) (321) and two paper rolls (or plastic rolls) (36) (37) respectively attached thereto. A take-up wheel axle (33) extends transversely crossing through the side walls (221) (222) of the middle holder (22) with one driving wheel (331) fixedly attached at both ends. Each of said driving wheels (331) has a groove (332). When wheel hubs (35) are bilaterally slipped over the take-up axle (33) at both ends the protruding portion (351) of each wheel hub (35) engages with the groove (332) of each driving wheel (331) to let the wheel hub (35) rotate with the respective wheel axle (33). Said take-up wheel axle (33) comprises a sector gear (333) engaged with the sector gear (341) of the vertical axle (34). Said vertical axle (34) comprises a hand wheel (342) at the top for manual operation to turn the wheel hub (35) for rotation. Said middle holder (22) also comprises two fixed paper guide rods (38) (39) for guiding the paper rolls (36) (37) in a way that the end of each paper roll (36) (37) is pulled to run beneath the paper guide rod (38) to cover the top surface of the lavatory seat (10) and the flat portion (14) (15) and is deflected at the front end of respective flat portion (14) (15) to run under the bottom of the lavatory seat (10) and beneath the paper guide rod (39) to wind round the wheel hub (35). If paper rolls or plastic rolls (36) (37) are printed with marks at proper intervals, it will help the user to precisely replace the paper or plastic when manually operating the hand wheel (342). Further, the side walls (221) (222) of the middle holder (22) comprise respective projections (223) for connecting respective side covers (23) (24) by means of protecting joints. When the paper rolls (36) are to be replaced, both side covers (23) (24) should be moved away.

Figure 3:
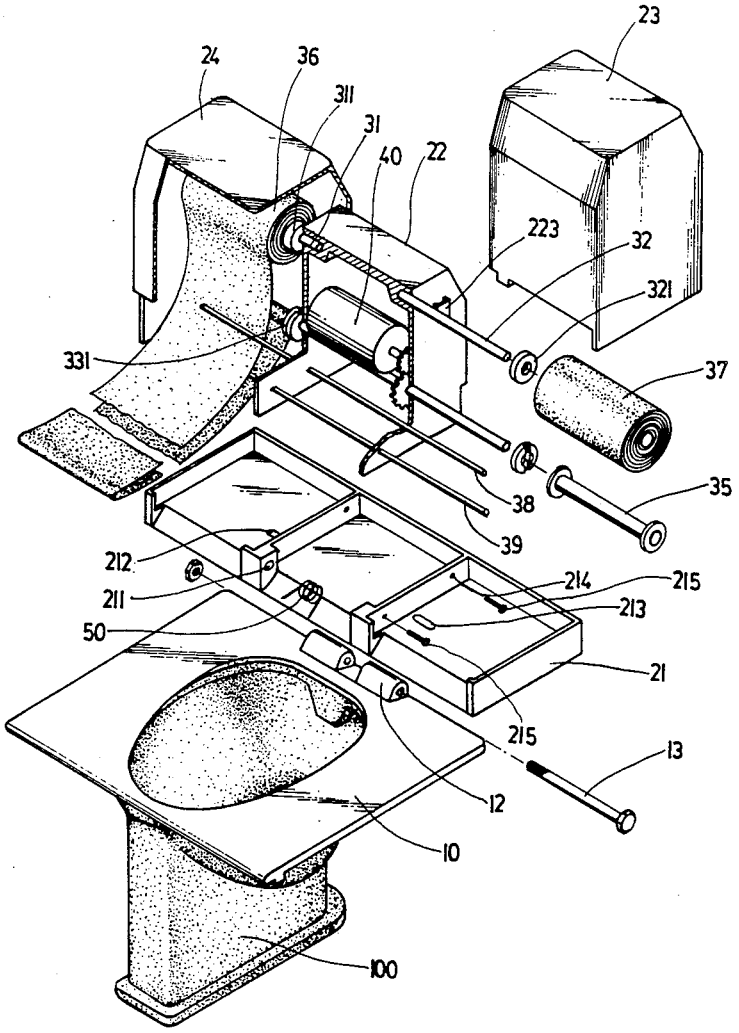
FIG. 3 is a fragmentary perspective view of the other preferred embodiment according to the present invention.

The driving mechanism of the sanitary lavatory seat according to the present invention can be a mechanical type as shown in FIG. 1 which consists of one vertical axle (34), two sector gears (333) (341), and one hand wheel (342), or the driving mechanism can also be a motor (40) for driving the take-up wheel axle (33) as shown in FIG. 3. Furthermore, the front end of the lavatory seat (10) can also be in a configuration as shown in FIG. 3 wherein the front end of the lavatory seat (10) comprises two circular ar portions (14) (15) for easy sliding of respective paper rolls (36) (37). When not in use, the lavatory seat (10) is slightly lifted by means of a spring (50) as shown in FIG. 3 such that the lavatory seat (10) is not in contact with the lavatory bowl (100) to facilitate circling of paper rolls (36) (37).

The preferred embodiment according to the present invention, as described above, has been proven to be practicable and can provide the effectiveness expected. However, the above described preferred embodiments are just examples for full understanding and any modification based on the concept of the present invention shall not be regarded as a departure from the spirit and scope of the invention, and al such modifications as would be obvious to one skilled in the art are intended to be included within the scope of the present application.

I claim:

1. A sanitary lavatory seat system comprising:

a lavatory seat having two generally flat portions and having a protruding portion at the rear thereof, said lavatory seat being positioned above a lavatory bowl;

a casing positioned at the rear of a lavatory bowl, said casing being solely mounted to said protruding portion and said lavatory bowl whereby said sanitary lavatory seat system is free-standing on the lavatory bowl, said lavatory seat being pivotally attached about said protruding portion to said casing whereby said lavatory seat can be raised against said casing, said casing further having a bottom holder, a middle holder and two side covers cooperating with said bottom holder to provide an encloses space on each side of said middle holder;

a wheel axle within each of said two side covers for receiving rolls of covering material;

a take-up wheel axle extending from said middle holder into said two side covers and positioned beneath said wheel axle, each of said rolls having a terminal end which is extended out of a bottom slot of the casing, over the top of one of the generally flat portions of the lavatory seat, deflected around a front edge of the generally flat portion, extended under the generally flat portion, returned into the casing and wound around the take-up wheel axle;

a pair of fixed guide rods within each of the two side covers, one of the pair of rods guiding the covering material leaving the casing through the slot and the other of the pair of rods guiding the covering material returning to the casing to be wound around said take-up wheel, said one pair of at guide rods being positioned beneath said wheel axle; and drive means positioned within said middle holder for rotating the take-up wheel axle to synchronously slide the covering material over the lavatory seat for a fixed length to thereby cover the two generally flat portions of the lavatory seat and to present a clean and sanitary portion of the covering material upon each activation of the drive means;

each of said wheel axles, said take-up wheel axle, said pair of fixed guide rods and said drive means all being located within said enclosed space of said casing whereby said covering material can assuredly remain clean until moved out of said casing and over the top of the generally flat portions of the lavatory seat by said drive means and whereby damage to said wheel axles, take-up wheel axle, guide rods and drive means can be avoided further comprising a wheel hub positioned on said take-up wheel axle for each of said rolls and a driving wheel fixedly attached on said take-up wheel axle of each of said wheel hubs, said driving wheel being rotatable with said take-up wheel axle and having a groove therein for receiving a portion of the wheel hub to lock the hub therewith whereby said wheel hub will be rotated with said take-up wheel axle, each of said wheel hubs being longitudinally slidable along said take-up wheel axle to facilitate replacement of the covering material.

2. The sanitary lavatory seat system as recited in claim 1, wherein said drive means comprises a gear fixed to said take-up wheel axle and a generally vertical axle positioned within said middle holder of said casing, said generally vertical axle having a gear meshing with said gear fixed to said take-up wheel axle whereby rotation of said generally vertical axle rotates said take-up wheel axle, a hand wheel being provided on an end of said generally vertical axle for manual rotation of said generally vertical axle.

3. The sanitary lavatory seat system as recited in claim 1, wherein said drive means comprise a motor positioned within said middle holder to said casing and operatively connected to said take-up wheel axle.

4. The sanitary lavatory seat system as recited in claim 1, wherein said covering material is one of paper or plastic and wherein said covering material has marks at fixed intervals to aid identification of placement of the covering material whereby said material can be precisely moved.

5. The sanitary lavatory seat system as recited in claim 4, wherein a spring is provided beneath the lavatory seat proximate to said protruding portion at a rear of said lavatory seat to lift said lavatory seat to facilitate movement of said covering material.

6. The sanitary lavatory seat system as recited in claim 1, wherein said covering material is one of paper or plastic and wherein said covering material has marks at fixed intervals to aid identification of placement of the covering material whereby said material can be precisely moved.

7. The sanitary lavatory seat system as recited in claim 1, wherein a spring is provided beneath the lavatory seat proximate to said protruding portion at a rear of said lavatory seat to lift said lavatory seat to facilitate movement of said covering material.

8. The sanitary lavatory seat system as recited in claim 1, further comprising lugs positioned beneath each of the generally flat portions of the lavatory seat toward the front thereof, said lugs preventing lateral displacement of the covering material.

* * * * *